US005438346A

United States Patent [19]

Fujimoto

[11] Patent Number: 5,438,346

[45] Date of Patent: Aug. 1, 1995

[54] COMPATIBLE THERMAL HEAD HAVING STROBE SIGNAL CONVERTING MEMBER

[75] Inventor: Hisayoshi Fujimoto, Kyoto, Japan

[73] Assignee: Rohm Co., Ltd., Kyoto, Japan

[21] Appl. No.: 25,647

[22] Filed: Mar. 3, 1993

[30] Foreign Application Priority Data

Mar. 4, 1992 [JP] Japan ..... 4-047145

[51] Int. Cl.[6] ..... B61J 2/35; B61J 2/355

[52] U.S. Cl. ..... 347/211; 347/13

[58] Field of Search ..... 346/76 PH; 400/120; 347/13

[56] References Cited

U.S. PATENT DOCUMENTS 5,072,237 12/1991 Takaoka ..... 346/76 PH 5,159,693 10/1992 Tatsuzawa ..... 346/76 PH

*Primary Examiner*—Huan H. Tran

*Attorney, Agent, or Firm*—Fish & Richardson

[57] ABSTRACT

A compatible thermal head includes multiple heat generating elements arranged in a row on a substrate, and multiple drive devices, selectively coupled to the heat generating elements, for driving a corresponding at least one of the heat generating elements. The quantity of drive devices is less than the quantity of heat generating elements. Also included in the thermal head are a strobe signal input device for receiving multiple external strobe signals as input, and a number-of-strobe-signals converting device, integral to the thermal head and coupled to the strobe signal input device, for converting the multiple external strobe signals received by the strobe signal input device into multiple internal strobe signals. The quantity of the internal strobe signals is greater than the quantity of the external strobe signals. The number-of-strobe-signals converting device supplies the internal strobe signals to corresponding ones of the drive devices to cause the drive devices to drive the corresponding at least one heat generating element in accordance with the internal strobe signal.

7 Claims, 5 Drawing Sheets

COMPATIBLE THERMAL HEAD HAVING STROBE SIGNAL CONVERTING MEMBER

BACKGROUND OF THE INVENTION

1. Field of the Invention

This invention relates to a thermal head, and an electronic equipment, such as a facsimile machine, printer, plotter or bar code printer, having such a thermal head.

2. Description of the Related Art

In recent years, with the spread of printers and facsimile machines of the thermal or thermal transfer type equipped with a thermal head, downsizing and large-scale-integration of the individual parts are on the increase in an effort to meet expanding demands for compact size and low cost. As downsizing and energy-saving have been demanded for electronic equipment, it is important and inevitable to reduce a total energy consumption, energy particularly in battery-operated equipment. To this end, the following conventional methods have been considered:

(1) The glazed layer (thin film) on the substrate, on which heat generating elements of a thermal head are arranged, is formed from an increased thermally insulating organic material instead of glass to retard heat conduction toward a lower part of the substrate. For example, assuming that the glazed layer is a polyimide layer of 3 to 15 μm in thickness, it is possible to reduce essential energy supply for a single heat generating element from 0.25 mJ to about 0.13 mJ.

(2) In another method, as indicated by a curve 21 of FIG. 4, a large amount of power is supplied in a short time ($t_0$ to $t_2$), for energy supply to heat generating elements, to increase the peak temperature by making the temperature gradient steep, thus increasing the ratio of energy quantity (area of the shaded region above the color developing temperature) for color development of a recording paper to total energy quantity supplied. According to this method, compared to the case of a relatively long-time ($t_0$ to $t_1$) energization at a low peak temperature as indicated by a curve 22, though a total quantity of energy supply (product of the power and the energizing time) is substantially the same, the energy quantity for color development is substantially increased, thus improving the energy efficiency. Therefore, to the contrary, when the same printing result is to be obtained, as indicated by a curve 23 of FIG. 4, it is possible to reduce the total amount of energy supply by further shortening the energizing time ($t_0$ to $t_3$) with the same energy quantity (area of the shaded region above the color developing temperature) for color development as the case of the curve 22.

In the above method (2), since it is necessary to supply a large amount of power to the individual heat generating element in a short time, the number of heat generating elements to be energized simultaneously is limited to a small number in view of a current capacity of the power source in use. The reasons for this will now be described.

Generally, in controlling a thermal head, a plurality of driver ICs are used to drive and control the respective heat generating elements. For example, in the thermal head 11 shown in FIG. 5, 27 driver ICs 14-1 to 14-27 are mounted on a thermal head substrate 12, and each driver IC drives 64 heat generating elements so that 27 driver ICs drive a row 13 of 1728 heat generating elements in total. These 27 driver ICs are divided into four blocks including 7 driver ICs, 7 driver ICs, 7 driver ICs and 6 driver ICs, and each block is energized and controlled, in time sharing mode, by the strobe signals STR1 to STR4 supplied from an external source. Namely, a block is selected for every strobe signal so that the corresponding 64×7 (or 64×6) heat generating elements are energized. For example, as shown in FIG. 6, assuming that the pulse width of each strobe signal STR1 to STR4 is 2 ms, four blocks of driver ICs are successively driven so that printing for a single line (1728 heat generatings elements) takes place in 8 ms in total.

Now assuming that, for example, a resistance R of every heat generating element is 3000 Ω and a driving power V is 24 V, a current $I_e$ flowing in each heat generating element and a consumption power $P_e$ of the heat generating element are expressed by the following equations (1) and (2):

$$I_e = V/R = 8\ [mA] \quad (1)$$

$$P_e = VXI = 0.192\ [W] \quad (2)$$

Therefore, in the total heat generating elements energized and driven concurrently with the individual strobe signals, a power $P_{max}$ at maximum expressed by the following equation (3) will be consumed:

$$P_{max} = 0.192\ [W] X 64 \times 7 = 86\ [W] \quad (3)$$

An energy consumption E for each heat generating element is expressed by the following equation (4):

$$E_e = 0.192\ [W] \times 2[ms] = 0.384\ [mJ] \quad (4)$$

In this case, if the peak of heat generating temperature of each heat generating element is to be increased, a resistance of the heat generating element is lowered to allow a large amount of current to flow. However, this requires a power source having a large current capacity in total as the power consumption of the individual heat generating element increases. Consequently downsizing and energy saving of the electronic equipment are difficult to achieve.

Consequently it is essential to reduce the number of heat generating elements to be energized concurrently with the individual strobe signals to prevent any increase of the maximum power consumption. For this purpose, the driver ICs should be divided into many blocks to minimize the number of driver ICs for each block. The number of strobe signals also should therefore be increased, depending on the number of blocks.

However, if the number of strobe signals was merely increased, it would not be compatible with the conventional type thermal head. Also the wiring due to the increased number of signal lines would become complicated, thus resulting in an increased cost of production.

SUMMARY OF THE INVENTION

It is therefore an object of this invention to provide a thermal head which can reduce the energy consumption by efficient energy supply in a short time of energization and guarantee compatibility with the conventional type of equipment.

According to the invention, there is provided a thermal head comprising: a multiplicity of heat generating elements arranged in rows on a substrate; a print data storage means for storing data to be printed; a number-of-strobe-signals increasing means for increasing the number of given strobe signals; and a drive means for driving, in a timed sharing mode, the corresponding heat generating elements in timed relation with the strobe signals output from the number-of-strobe-signals increasing means, based on the data stored in the print data storage means.

The number-of-strobe-signals increasing means may be an n-to-N decoder for decoding n-bit binary data into N-bit (N>n) binary data. In this case, n strobe signals are converted into N strobe signals by the decoder for supply to the drive means.

DETAILED DESCRIPTION

One embodiment of this invention will now be described with reference to the accompanying drawings.

Figure 1:
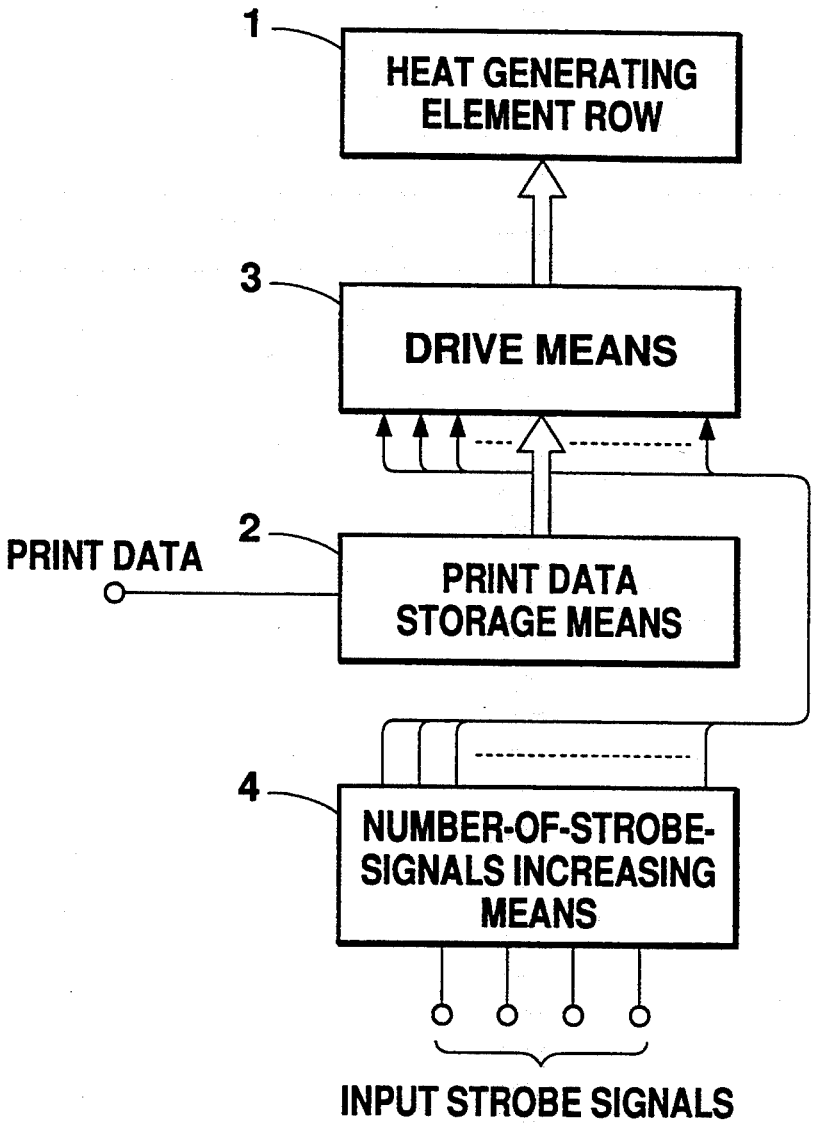
FIG. 1 is a diagram showing the principle of this invention.

FIG. 1 shows the principle of a thermal head according to one embodiment of this invention. As shown in FIG. 1, a heat generating element row 1 is connected to a drive means 3 which is connected to a print data storage means 2 and a number-of-strobe-signals increasing means 4. The print data storage means 2 stores print data input from a data input terminal and supplies the print data to the drive means 3. The number-of-strobe-signals increasing means 4 produces more than four (in the illustrated example) strobe signals based on four (in the illustrated example) strobe signals input from strobe input terminals and supplies them to the drive means 3. The drive means 3 drives corresponding heat generating elements of the heat generating element row 1 in timed relation with the strobe signals from the number-of-strobe-signals, increasing means 4, based on print data stored in the print data storage means 2.

The construction and operation of the thermal head of FIG. 1 will now be described in greater detail.

Figure 2:
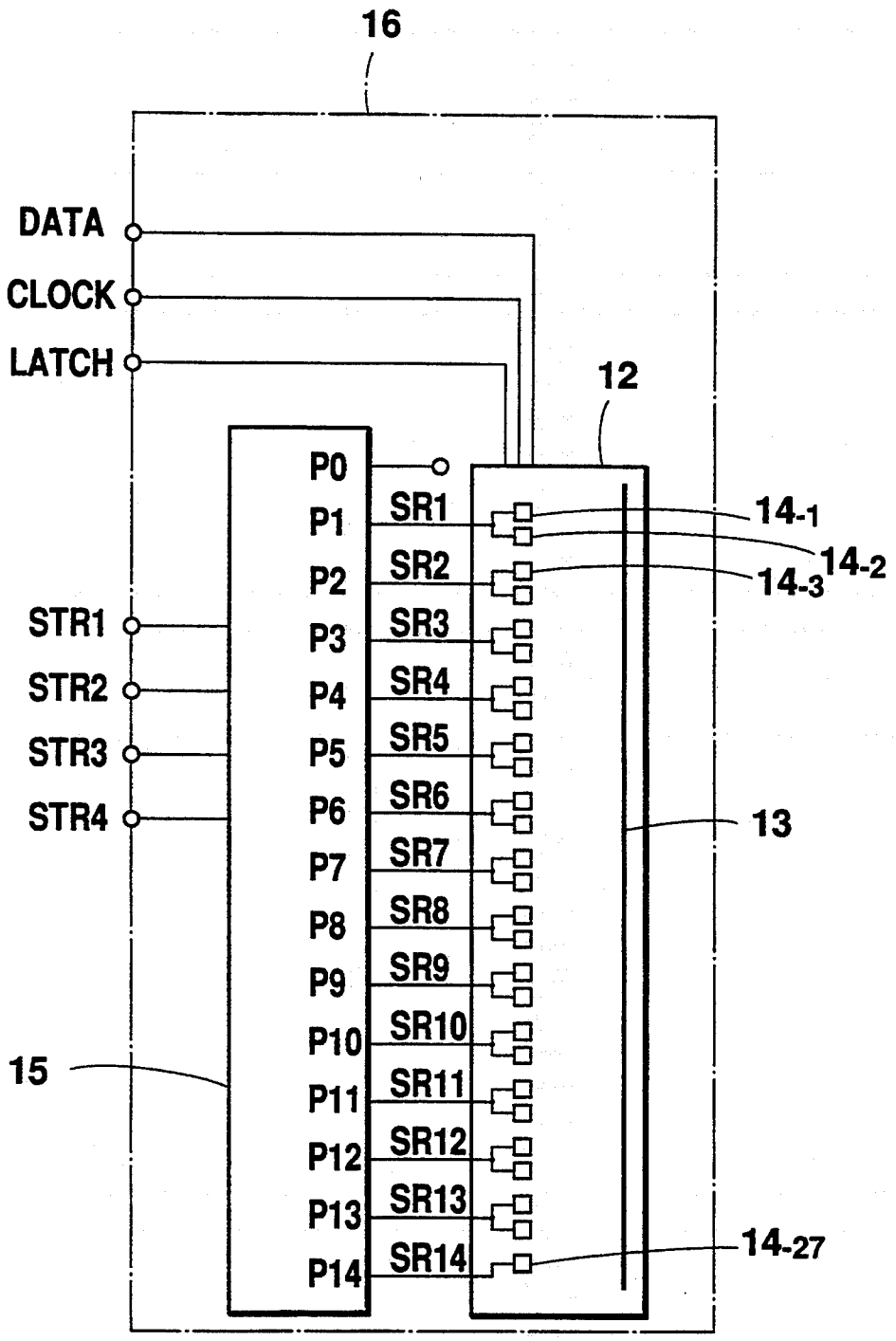
FIG. 2 is a block diagram showing a thermal head according to one embodiment of the invention.
Figure 5:
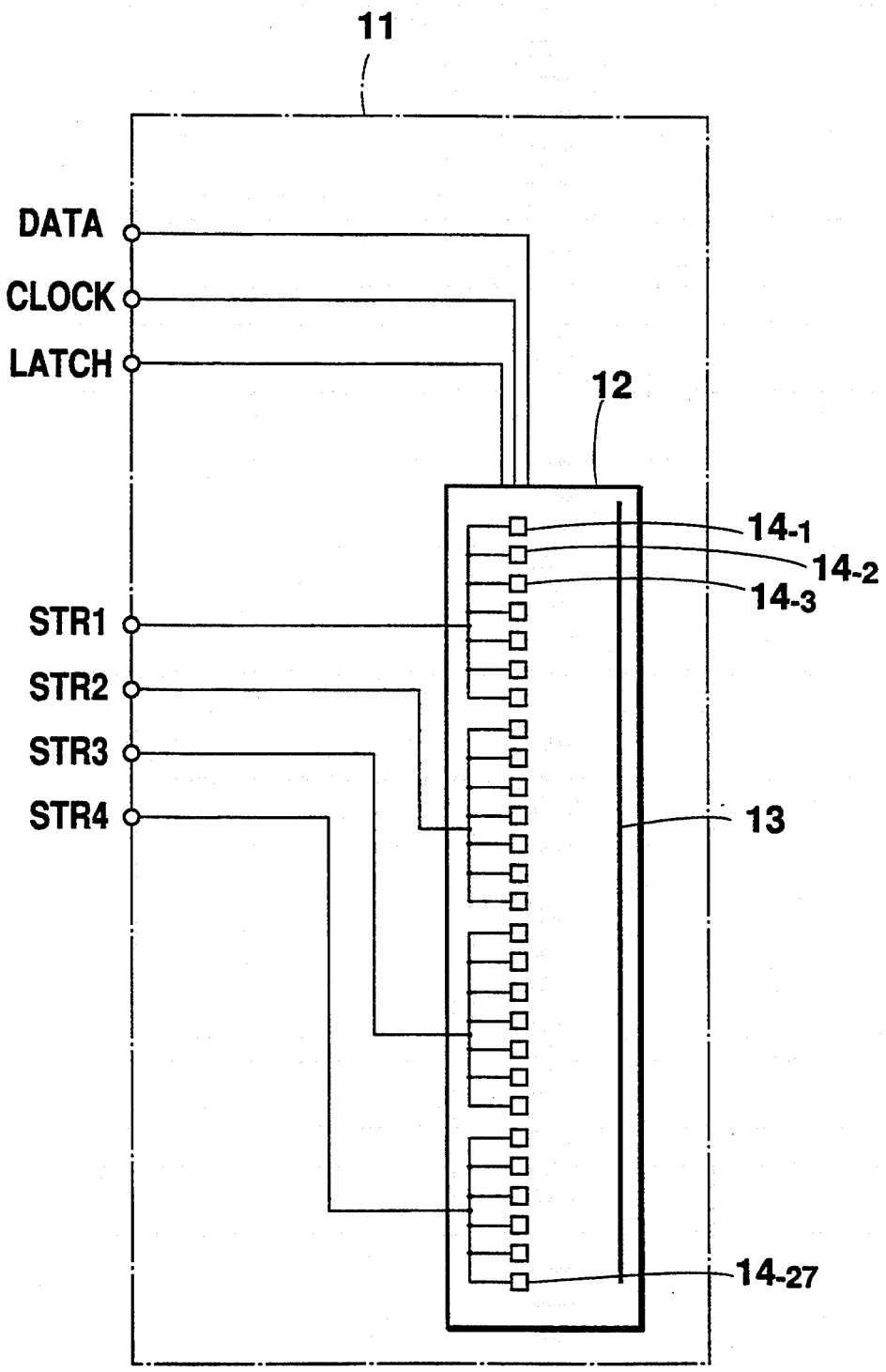
Fig. 5 PRIOR ART
FIG. 5 is a block diagram showing a conventional thermal head.

FIG. 2 shows a thermal head 16 to be used in, for example, an A4-size G-III facsimile machine. In FIG. 2, elements or parts similar to those of the conventional art (FIG. 5) are designated by like reference numerals.

The thermal head 16 has a data terminal for inputting print data (DATA), a clock terminal for inputting clock signals (CLOCK) and a latch terminal for inputting latch signals (LATCH), each terminal being operatively connected to 27 driver ICs 14-1 to 14-27 mounted on a thermal head substrate 12.

Each driver IC, like the conventional one, is composed of a 64-bit shift register for storing print data, a latch circuit for latching print data, and driving elements for energizing 64 corresponding heat generating elements, based on the latch data of the latch circuit, in response to the strobe signals.

On the thermal head substrate 12, a row 13 of 1728 heat generating elements similar to the conventional ones is mounted; 64 heat generating elements are controlled by each of the driver ICs 14-1 to 14-27.

Further, the thermal head 16 has strobe signal input terminals for inputting 4-bit strobe signals STR1 to STR4 connected to a decoder 15. The decoder 15 decodes the input 4-bit strobe signals to produce 14 strobe signals SR1 to SR14 for output from output terminals P1 to P14, which is one of the most characteristic features of this invention.

The strobe-signals SR1 to SR14 are supplied respectively to 14 blocks comprising 27 driver ICs of the thermal head substrate 12. For example, the strobe signal SR1 is supplied to the driver IC blocks 14-1 and 14-2, and the strobe signal SR2 is supplied to the driver IC blocks 14-3 and 14-4, and so forth.

Figure 3:
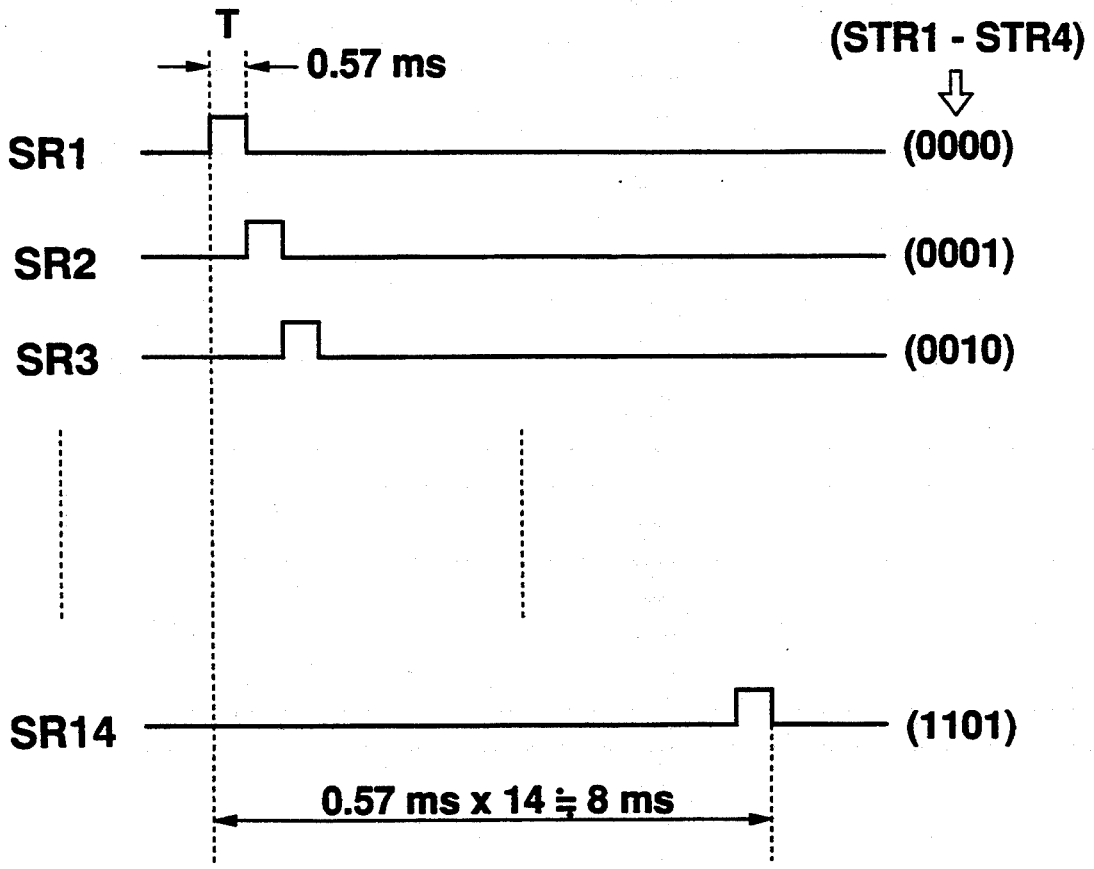
FIG. 3 is a timing diagram showing timing characteristics of strobe signals of the thermal head of FIG. 2.

The operation of the foregoing thermal head will be described with reference to FIG. 3. For printing a certain line, when strobe signals STR1 to STR4 of a bit combination of (0000) are input, the decoder 15 decodes them and outputs a strobe signal SR1 (FIG. 3) having a pulse width T. Then when strobe signals STR1 to STR4 of a bit combination of (0001) are input, the decoder 15 decodes them and outputs a strobe signal SR2 (FIG. 3) having the same pulse width T. As this procedures take place successively, finally the strobe signals STR1 to STR4 of a bit combination of (1101) are input and outputs a strobe signal SR 14 (FIG. 3) having a corresponding pulse width T, whereupon the operation for a single line is completed.

While the individual strobe signals SR1 to SR14 are supplied, the individual driver ICs of each of 14 blocks energizes the corresponding heat generating elements, based on print data latched by the latch circuit, to start printing. Namely, for each of the strobe signals SR1 to SR13, the corresponding two driver IC blocks are driven, and for the last strobe signal SR14, only a single driver IC 14-27 is driven.

Figure 4:
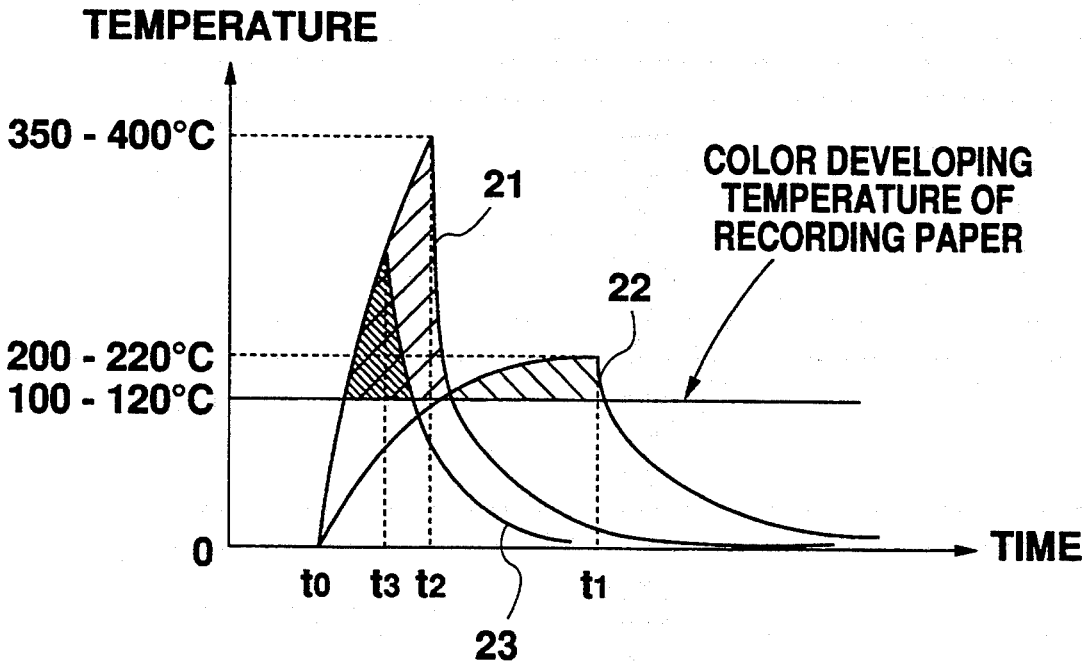
FIG. 4 is a diagram showing the relation of temperature (current) of a heat generating element of the thermal head with respect to time.

However, as described above in connection with the conventional art, for making the temperature gradient of each heat generating element steep to increase its temperature peak like the curve of FIG. 4, it is necessary to lower the resistance of each heat generating element to allow more current to flow. Assuming that the resistance R of each heat generating element is, for example, 1200 Ω and the driving voltage V is 24 V, a current $I_e$ flowing in the heat generating element and a power consumption power $P_e$ thereof are obtained by the following equations (5) and (6):

$$I_e = V/R = 20\ [\text{mA}] \tag{5}$$

$$P_e = VXI = 0.48\ [\text{W}] \tag{6}$$

Accordingly the whole of the thermal heads will consume a maximum power $P_{max}$ for every strobe signal, as obtained as follows:

$$P_{max} = 0.48\ [W] X 64 \times 2 \simeq 61\ [W] \tag{7}$$

Figure 6:
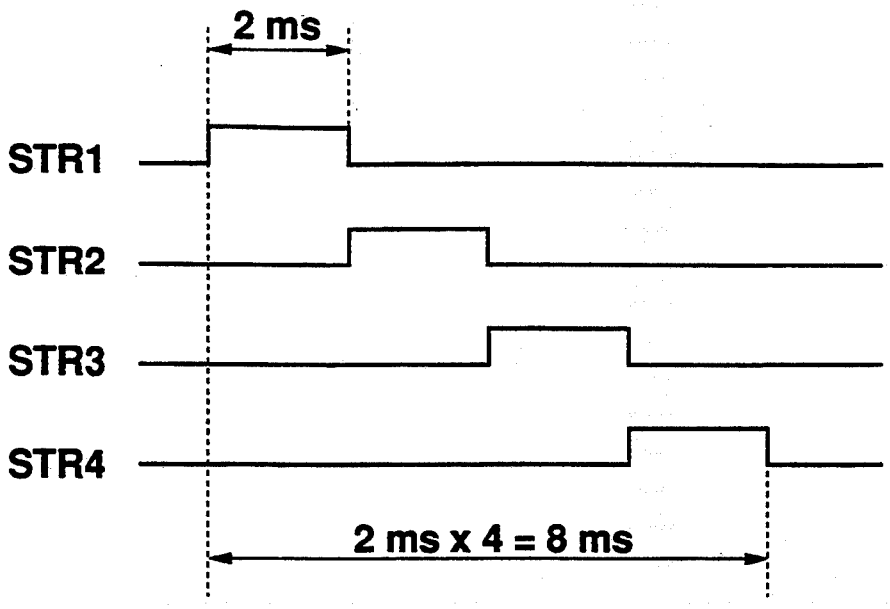
Fig. 6 PRIOR ART
FIG. 6 is a timing diagram showing timing characteristics of strobe signals of the thermal head of FIG. 5.

At that time, since the time (e.g., 8 ms) needed for printing a single line must be the same as with the conventional case (FIG. 6), the pulse width T of each strobe signal SR1 to SR14 must be as follows:

$$T = 8/14 \simeq 0.57\ \text{ms} \tag{8}$$

Therefore the energy consumption $E_e$ of each heat generating element will be as expressed by the following equation (9):

$$E_e = P_e XT = 0.48\ [W] \times 0.57\ [ms] \approx 0.27\ [mJ] \quad (9)$$

As is apparent from the equations (7) and (9), either the energy consumption of each heat generating element or the needed power capacity will be reduced, as compared to the conventional case as expressed by the equations (3) and (4).

The resistance R of the heat generating element and the pulse width T of each strobe signal should by no means be limited to the above-mentioned values; if an energy quantity at above the color developing temperature of a recording paper in FIG. 4 is kept constant, it is possible to secure the same print quality and same energy. However, since the pulse width T of the strobe signal depends on the number of strobe signals, the decoder 15 (FIG. 2) requires the type of 4 inputs and 5–13 outputs instead of the 4-input-and-14-output type. Further, assuming that the thermal head is for a B4 size rearding and has 2048 heat generating elements, it is preferably divided by 16 (=2048/6412) in view of the limitation of the maximum power consumption, and also 5 strobe signal input lines are needed for the strobe-off timing.

In view of uses for various recording paper sizes and compatibility, the number of inputs may for example, be 2, 3 or 6 to increase to the needed number of strobe signals.

As described above, according to this invention, since the corresponding heat generating elements are driven in timed relation with the strobe signals from the number-of-strobe-signals increasing means, based on the data stored in the print data storing means, multiple time-sharing driving for a greater than the given number of strobe signals can be achieved, thereby keeping it compatible with the existing type of strobe signal terminals. Since the number of heat generating elements to be driven concurrently is relatively small, it is possible to increase the current consumption of each heat generating element without increasing the power source capacity. Further, since short-time driving takes place with increasing the current consumption of each heat generating element, it is possible to supply energy efficiently by minimizing the energy quantity to be lost due to heat conduction, thus saving energy.

What is claimed is:

1. A compatible thermal head comprising:

a plurality of heat generating elements arranged in a row on a substrate;

a plurality of drive means, selectively coupled to said plurality of heat generating elements, for driving a corresponding at least one of said plurality of heat generating elements, a quantity of said plurality of drive means being less than a quantity of said plurality of heat generating elements;

strobe signal input means for receiving as input a plurality of external strobe signals; and number-of-strobe-signals converting means, integral to said thermal head and coupled to said strobe signal input means, for converting the plurality of external strobe signals received by said strobe signal input means into a plurality of internal strobe signals, a quantity of the internal strobe signals being greater than a quantity of the external strobe signals, and wherein said number-of-strobe-signals converting means supplies the plurality of internal strobe signals to corresponding ones of said plurality of drive means to cause said plurality of drive means to drive said corresponding at least one heat generating element in accordance with the internal strobe signal.

2. A compatible thermal head according to claim 1, wherein the plurality of external strobe signals comprises n-bits of binary data, the plurality of internal strobe signals comprises N-bits of binary data, n and N being natural numbers, and N being greater than n, and wherein said number-of-strobe-signals converting means includes an n-to-N decoder for decoding the plurality of external strobe signals into the plurality of internal strobe signals.

3. A compatible thermal head comprising:

a plurality of heat generating elements;

a plurality of drive means, selectively coupled to said plurality of heat generating elements, for driving a corresponding at least one of said plurality of heat generating elements, a quantity of said plurality of drive means being less than a quantity of said plurality of heat generating elements;

strobe signal input means for receiving as input a plurality of external strobe signals; and compatibility producing means, integral to said thermal head and coupled to said strobe signal input means, for converting the plurality of external strobe signals received by said strobe signal input means into a plurality of internal strobe signals, a quantity of the external strobe signals being less than a quantity of the internal strobe signals, and wherein said compatibility producing means selectively supplies the plurality of internal strobe signals to corresponding ones of said plurality of drive means to cause said plurality of drive means to drive said corresponding at least one heat generating element in accordance with the internal strobe signal.

4. A compatible thermal head comprising:

a plurality of heat generating elements;

strobing means for strobing said plurality of heat generating elements by N periods per row; and compatibility producing means, integral to said thermal head and coupled to said strobing means, for converting a plurality of external strobe signals input from an external device into a plurality of internal strobe signals, a quantity of internal strobe signals being greater than a quantity of external strobe signals, wherein said strobing means strobes said plurality of heat generating elements in accordance with a corresponding one of the plurality of internal strobe signals.

5. A compatible thermal head comprising:

a plurality of heat generating elements arranged in a row on a substrate;

a plurality of drive means, selectively coupled to said plurality of heat generating elements, for driving a corresponding at least one of said plurality of heat generating elements, a quantity of said plurality of drive means being less than a quantity of said plurality of heat generating elements;

strobe signal input means for receiving as input a plurality of external strobe signals; and number-of-strobe-signals converting means, coupled to said strobe signal input means, for (i) converting the plurality of external strobe signals received by said strobe signal input means into a plurality of internal strobe signals, and (ii) for selectively supplying the plurality of internal strobe signals to corresponding ones of said plurality of drive means to cause said plurality of drive means to drive said corresponding at least one heat generating element in accordance with the internal strobe signals, wherein a quantity of internal strobe signals is greater than a quantity of external strobe signals, and wherein, each of the internal and external strobe signals having a pulse width, a sum of the pulse widths for each of the plurality of internal strobe signals is substantially equal to a sum of the pulse widths for each of the plurality of external strobe signals.

6. A compatible thermal head according to claim 5, wherein the pulse width of a single internal strobe signal is determined by dividing the sum of the pulse widths for each of the plurality of external strobe signals by the quantity of internal strobe signals.

7. A compatible thermal head according to claim 5, wherein each internal strobe signal has a substantially same pulse width.

* * * * *